US011767647B2

(12) United States Patent
Valencia et al.

(10) Patent No.: US 11,767,647 B2
(45) **Date of Patent: *Sep. 26, 2023**

(54) SYSTEM AND METHOD FOR CHANGING A SURFACE CHARACTERISTIC OF A CONCRETE BRIDGE SURFACE

(71) Applicant: Terex USA, LLC, Westport, CT (US)

(72) Inventors: Javier Valencia, Sioux Falls, SD (US); Thomas Walter Spisak, Hartford, SD (US)

(73) Assignee: Terex USA, LLC, Westport, CT (US)

( * ) Notice: Subject to any disclaimer, the term of this patent is extended or adjusted under 35 U.S.C. 154(b) by 148 days.

This patent is subject to a terminal disclaimer.

(21) Appl. No.: 17/216,265

(22) Filed: Mar. 29, 2021

(65) Prior Publication Data

US 2021/0214902 A1 Jul. 15, 2021

Related U.S. Application Data

(63) Continuation of application No. 16/228,209, filed on Dec. 20, 2018, now Pat. No. 10,961,669.

(60) Provisional application No. 62/616,540, filed on Jan. 12, 2018.

(51) Int. Cl.
*E01D 21/00* (2006.01)
*E01D 101/24* (2006.01)

(52) U.S. Cl.
CPC ..... *E01D 21/00* (2013.01); *E01D 2101/24* (2013.01)

(58) Field of Classification Search
CPC ..... E01D 21/00; E01D 2101/24
See application file for complete search history.

(56) References Cited

U.S. PATENT DOCUMENTS

| | | | |
|---|---|---|---|
| 6,846,128 | B2 | 1/2005 | Sick |
| 9,739,019 | B1 | 8/2017 | Godbersen |
| 10,287,150 | B1 | 5/2019 | Miller |
| 10,494,772 | B1 | 12/2019 | Boston et al. |
| 10,829,898 | B2 | 11/2020 | Morrison |
| 2006/0193693 | A1 | 8/2006 | Congdon |
| 2007/0059098 | A1 | 3/2007 | Mayfield et al. |
| 2016/0054283 | A1 | 2/2016 | Stromsoe |
| 2016/0177517 | A1 | 6/2016 | Engels et al. |
| 2018/0030672 | A1 | 2/2018 | Marsolek et al. |
| 2018/0354351 | A1 | 12/2018 | Buschmann |
| 2019/0248265 | A1 | 8/2019 | Godwin, Jr. |
| 2019/0345677 | A1 | 11/2019 | Boston et al. |
| 2020/0011017 | A1 | 1/2020 | Jacob |
| 2020/0040533 | A1 | 2/2020 | Morrison |

FOREIGN PATENT DOCUMENTS

| | | | |
|---|---|---|---|
| EP | 2963181 | A1 | 1/2016 |
| JP | 6149349 | B2 | 6/2017 |

*Primary Examiner* — Abigail A Risic
(74) *Attorney, Agent, or Firm* — Simmons Perrine Moyer Bergman PLC

(57) ABSTRACT

An automated concrete bridge paver with an ability to provide effective control of a concrete paver by a remotely locatable concrete bridge paver operator, which includes a fixed operator control station and a mobile wireless remote operator control station which can be used when the remotely locatable concrete bridge paver operator leaves the operator control station. Mobile wireless remote operator control station includes a video screen which can display live video images from a plurality of remote wireless camera and sensor pods, which can be fixed on the paver or moved about the paver on an articulated arm, with or without a human basket.

19 Claims, 6 Drawing Sheets

SYSTEM AND METHOD FOR CHANGING A SURFACE CHARACTERISTIC OF A CONCRETE BRIDGE SURFACE

CROSS REFERENCE TO RELATED APPLICATIONS

The present application claims is a continuation of the non-provisional application having Ser. No. 16/228,209 filed on Dec. 20, 2018, which application claims the benefit of the filing date of provisional patent application having Ser. No. 62/616,540 filed on Jan. 12, 2018, by TEREX USA, LLC, which application is incorporated herein in its entirety by this reference.

FIELD OF THE INVENTION

The present invention generally relates to concrete paving, and more particularly relates to methods and machines for paving bridges.

BACKGROUND OF THE INVENTION

In the past, the bridge paving industry has utilized various different types of bridge pavers which typically have in common a requirement for a human operator perched in a prominent position at the paver's control station. Often, this operator may want, or need, to better observe an area on or immediately around the paver. Also, during set-up on a typical job site, the operator often receives instructions from a person off-board the paver. Because the paver's control station is often close to the internal combustion engine of the paver's often noisy power unit, the instruction may be in the form of hand signals and/or yelled voice commands of specific instructions on how to change the configuration of various aspects of the paver.

During a pour, the operator may, in many pavers, be capable of stepping away from the control station and walking on the paver to a different vantage point. In other situations, such as during a dry run in the presence of an inspector, the operator may need to actually stop the paver and get off to make the necessary observations and communicate with the inspector. While such movement away from the control station may be required, it consumes valuable time. Additionally, potential specification non-compliance and/or safety issues can arise or be increased anytime an operator either: actually moves about the paver or actually should move, but in fact does not move.

These issues can manifest themselves as either injury to the operator or other project personnel or in non-compliance to the specification, especially where the operators fails to fully perceive, investigate and/or act upon a problem or potential problem. One example of such an event may be an operator needing to step away to quickly inspect a concrete surface characteristic and rapidly make changes such as carriage speed and/or direction.

While many types of pavers are often outfitted with walkways with railings to facilitate movement of the operator on, off and some locations on the paver, the situational awareness of the operator is often less than optimal. For example, when the carriage is at or near a point of maximum distance from the operator station, it is difficult to see the quality and nature of the finish of the concrete surface behind the carriage, thereby making it difficult to accurately determine if it is necessary to make a change in the speed and/or direction of the carriage.

Consequently, there exists a need for improved methods and apparatuses for efficiently and safely making operational decisions and then making the necessary changes to the configuration of the paver.

SUMMARY OF THE INVENTION

It is an object of the present invention to empower the paver operator with improved visibility to the most relevant areas of a continuously changing work area.

It is a feature of the present invention to enable the operator to provide a mobile wireless remote operator control station providing the ability of the operator to move around onboard the paver, and even off-board the paver, while still maintaining immediate access to the control of the paver.

It is an advantage of the present invention to allow for improved situational awareness and the continuous ability to control the paver during its set-up and operation.

The present invention is carried out in a "distant viewless" manner, in a sense that occasions of an operator making a decision from a much less than optimal location are eliminated or at least greatly reduced.

Accordingly, the present invention is a method of improving operation of an automated concrete paver, comprising the steps of:

- providing a control station which is disposed on a concrete paver, where the control station is configured with controls so that movement of an actuator by a paver operator results in a first change in pressure at a first manipulatable implement separated from said control station;
- providing a mobile wireless operator control which is configured to cause said first change in pressure to occur when an input action occurs at said mobile wireless operator control;
- said paver operator moving with said mobile wireless operator control to a second location where a determination is made to cause said first change in pressure to occur; and
- while a first configuration of paving is underway, said paver operator manually interacts, at said second location, with a first button on said mobile wireless operator control without any manual interaction with said control station, and thereby causes said first change in pressure to occur.

Additionally, the present invention is system for improving operation of a concrete paver comprising:

- a control station disposed on a concrete paver where the control station is configured with manual hydraulic controls, including a manual actuator, when moved by a paver operator results in a first change in hydraulic pressure at a first hydraulically manipulatable device separate from the control station;
- an electronic controller, which is configured to cause said first change in hydraulic pressure to occur when an input action occurs by said paver operator with said electronic controller;
- said concrete paver having a first location distant from said control station, and a second location; and
- said electronic controller being configured to electronically communicate from said second location to one of said first location and said control station after a determination has been made to cause said first change in hydraulic pressure to occur.

BRIEF DESCRIPTION OF THE DRAWINGS

The invention may be more fully understood by reading the following description of the preferred embodiments of the invention, in conjunction with the appended drawings wherein.

DETAILED DESCRIPTION

Although described with particular reference to concrete bridge pavers, the systems and methods of the present invention can be implemented in many different types of pavers, which are independent of their paving material and their pavement support means.

In an embodiment, the system and method of the present invention described herein can be viewed as examples of many potential variations of the present invention which are protected hereunder. The following details are intended to aid in the understanding of the invention whose scope is defined in the claims appended hereto.

Figure 1:
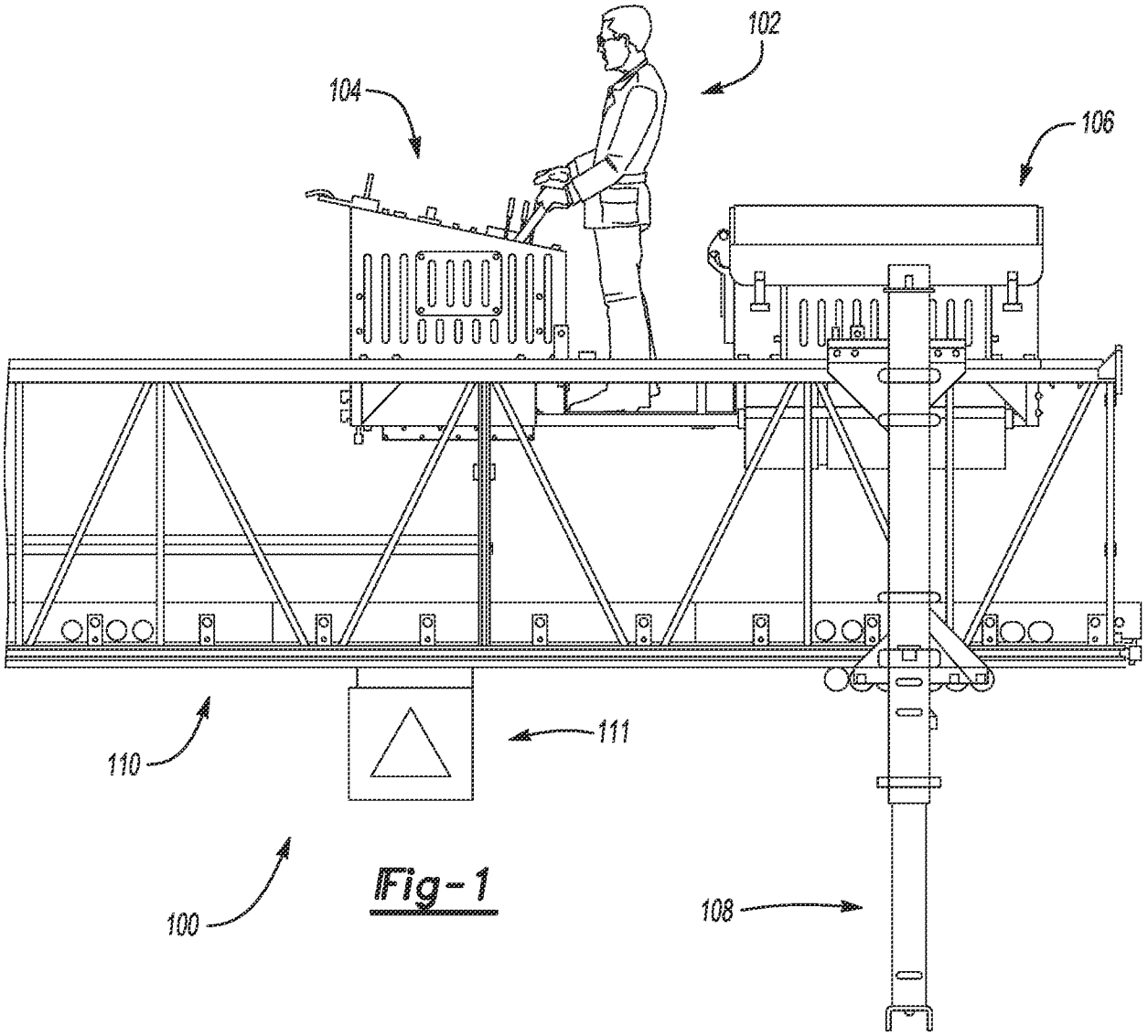
FIG. 1 is a simplified representation of a portion of a concrete bridge paver of the prior art.

Now referring to the drawings wherein like numerals refer to like matter throughout, and more particularly in FIG. 1, there is shown a diagram illustrating a simplified version of a concrete bridge paver 100 of the prior art, which includes a concrete bridge paver operator 102, an operator control station 104, a power unit 106, a power leg 108, which can be configured as or with a separate hydraulically manipulatable implement, and a concrete paver frame boom 110. Also, shown is carriage 111 which moves along concrete paver frame boom 110 to aid in finishing the concrete surface, as is well known in the prior art. These are merely representative elements of very well-known prior art bridge paving systems and methods.

Figure 2:
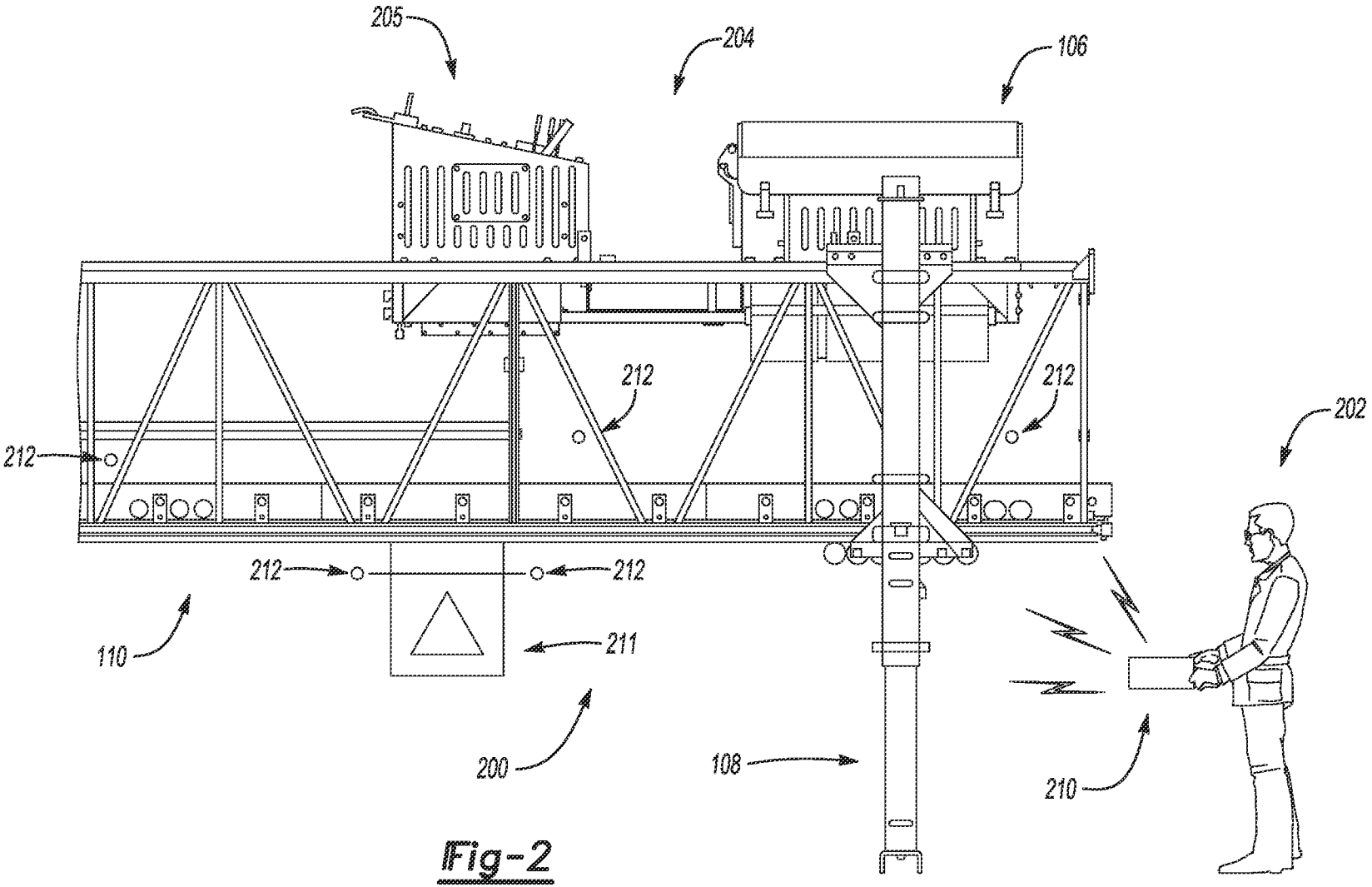
FIG. 2 is a simplified representation of a portion of a concrete bridge paver of the present invention.

Now referring to FIG. 2, there is shown a concrete bridge paver 200, of the present invention, which includes a novel operator control station 204 which provides functionality similar to that provided by operator control station 104, but also includes fixed remote control receiver 205, which is an electronic component designed to receive, demodulate and/or distribute electronic signals received from mobile wireless remote operator control station 210, so that such electronic signals can, with the aid of additional electronic interfaces and electronic controllable devices, provide for an additional mode of control of all, or substantially all, of the control functions normally provided by operator control station 104. In one embodiment, the fixed remote control receiver 205 could be a robust receiver/transmitter for facilitating high data throughput two-way communications with mobile wireless remote operator control station 210. Remotely locatable concrete bridge paver operator 202, with the aid of mobile wireless remote operator control station 210, is free to move on and around the concrete bridge paver 200 and closely inspect many aspects of the paving project while still having control of the concrete bridge paver 200 without a need to return to the operator control station 204. Also shown is carriage 211 which could, in some embodiments, be identical to carriage 111 or could, in more advanced embodiments, be further adapted to provide features such as remote start and control of:

1. the carriage power unit,
2. the augers,
3. any vibration implement and its frequency and magnitude of vibration, and
4. the vertical displacement controlling linkage with concrete paver frame boom 110.

Also shown are a plurality of representative remote wireless camera and sensor pods 212. Remote wireless camera and sensor pods 212 can be fixed at predetermined locations on the concrete bridge paver 200 or they may, in some embodiments, be moved around the paver with a means for improving an operators vantage point which could be an articulating arm, coupled to concrete bridge paver 200, which is capable of being electronically steered to be closer to remote portions of the concrete bridge paver 200. In one embodiment, the articulated arm could be sized, configured, and controlled much like an aerial lift or bucket truck with a bucket or basket for safely moving a human, as well as remote wireless camera and sensor pods 212.

In other embodiments, multiple mobile wireless remote operator control stations 210 can be used by a plurality of persons for operation of the concrete bridge paver 200. In some embodiments, the mobile wireless remote operator control station 210 can be replaced by or augmented with fixed remote operator control stations which could be wired or wireless. These fixed remote operator control stations could be located anywhere on the concrete bridge paver 200, including the power legs, at the operator control station 204, the bucket or basket when an aerial lift is provided.

Figure 3:
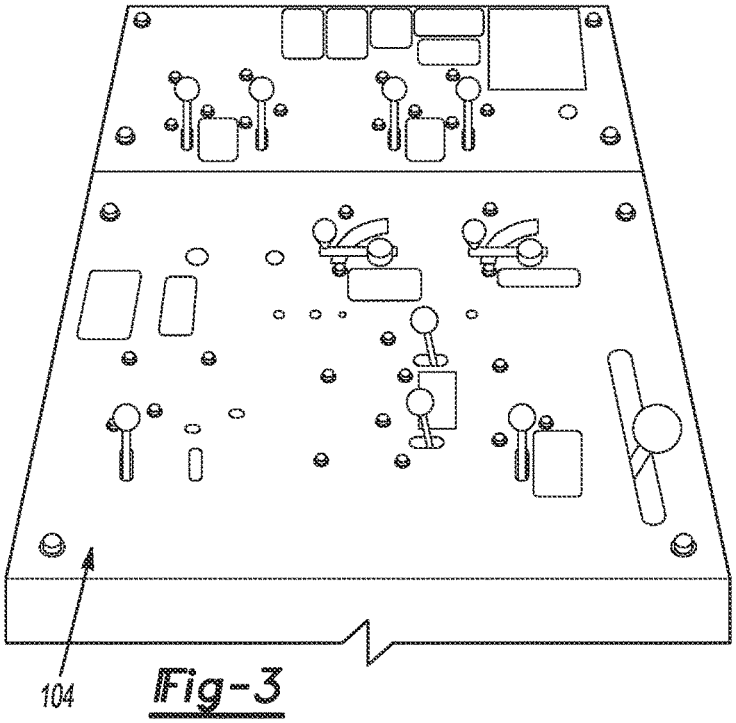
Fig-3 PRIOR ART
FIG. 3 is a close-up view of the operator control station 104 first shown in FIG. 1.

Now referring to FIG. 3, there is shown a representation of an operator control station 104 of the prior art, which is well known in the art.

Figure 4:
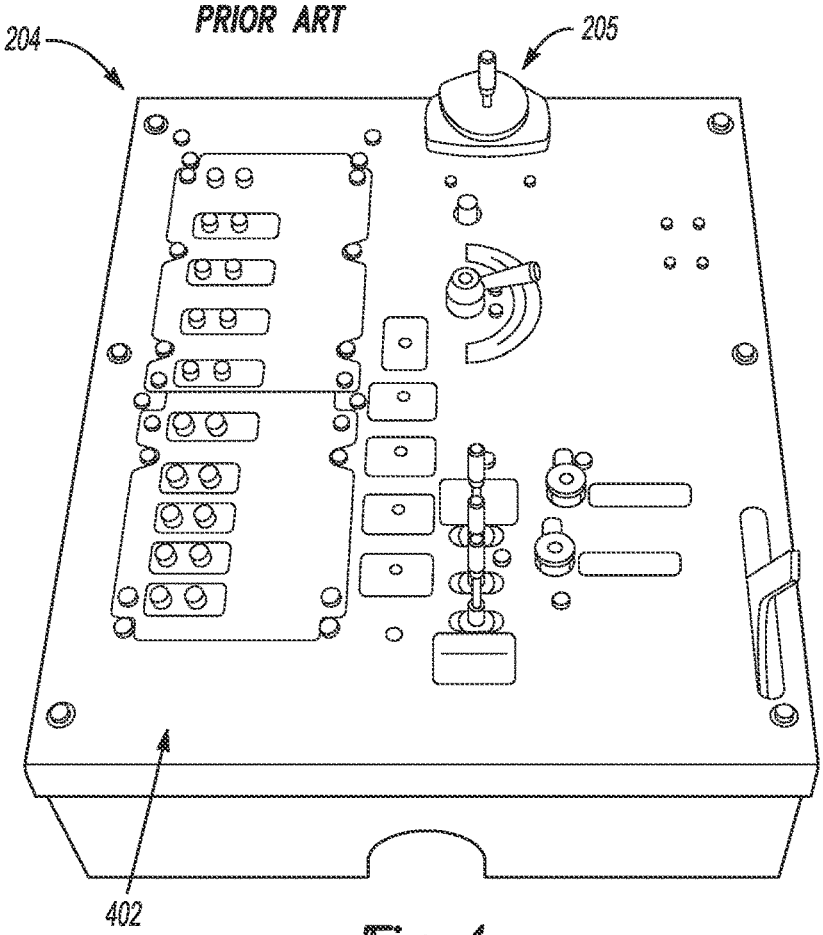
FIG. 4 is a close-up view of the operator control station 204 first shown in FIG. 2.

Now referring to FIG. 4, there is shown a representation of operator control station 204 of the present invention. The various control buttons, switches, sticks, knobs, etc., which extend through cover panel 402, are merely representative of controls which can be expected on normal concrete bridge pavers, such as the controls shown on operator control station 104 in FIG. 3. One main exception is fixed remote control receiver 205, which is a wireless interface between the operator control station 204 and the mobile wireless remote operator control station 210. In a first possible embodiment, these controls, as they are touched by the remotely locatable concrete bridge paver operator 202, could be identical to those of operator control station 104, which are augmented with some adjacent electronic actuator to cause a command coming from mobile wireless remote operator control station 210 to physically manipulate the mechanical controls, as in a well-known prior art non-electronic control system. In a second possible embodiment, the control buttons, knobs etc., could be electronic buttons which then are coupled to an actuator which would manipulate a physical structure to effect the same changes, as if a person were to touch, with their hand, a control similar to those of operator control station 104. In a third possible embodiment, the controls in operator control station 204 could be substantially the same as in operator control station 104, except for an additional electronic manifold portion which accepts electronic signals and makes changes in the hydraulic lines exiting the operator control station 204, so that they mimic the changes in hydraulic lines leaving operator control station 104. The details of the electrical to mechanical interface of these controls of operator control station 204 are a matter of design choice and many combinations, permutations, variations and etc. of those enabled herein, to a person skilled in the art, could be substituted without a need for undue experimentation depending upon the requirements of any specific application.

Figure 5:
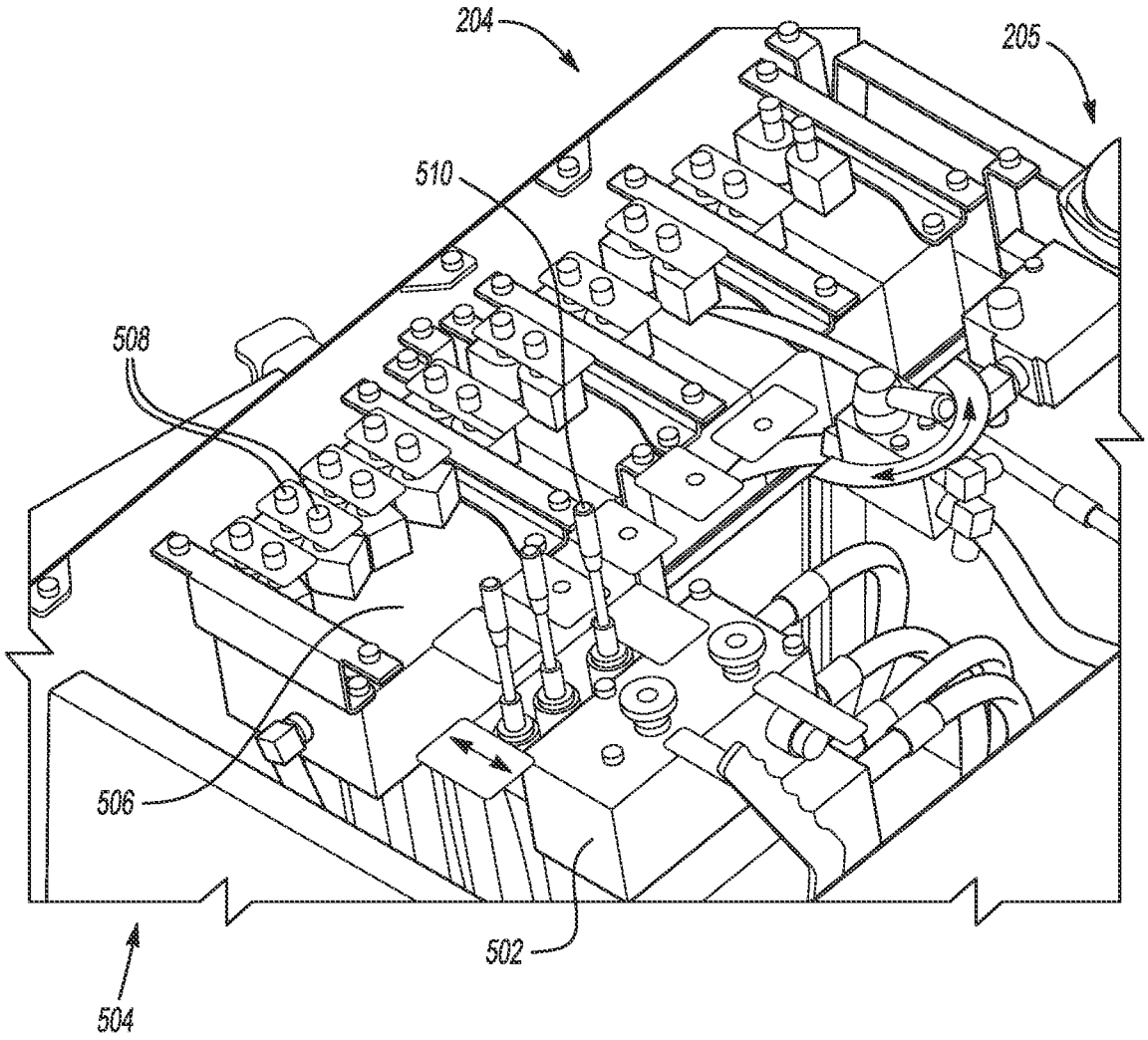
FIG. 5 is a view of the operator control station 204 without the cover panel 402, first shown in FIG. 4.

Now referring to FIG. 5, there is shown a representation of the operator control station 204 without the cover panel 402. This figure shows the third possible embodiment described in the preceding paragraph. Where the main hydraulic manifold 502 is shown adjacent to the auxiliary hydraulic manifold 504, which includes a plurality of dual mode controls, including electronic input control portion 506 for receiving signals from the mobile wireless remote operator control station 210 and the finger engaging manual control buttons 508, which interact with the operator's fingers. Also shown is manual control lever 510, which is a manual control to be physically manipulated by the operator.

Figure 6:
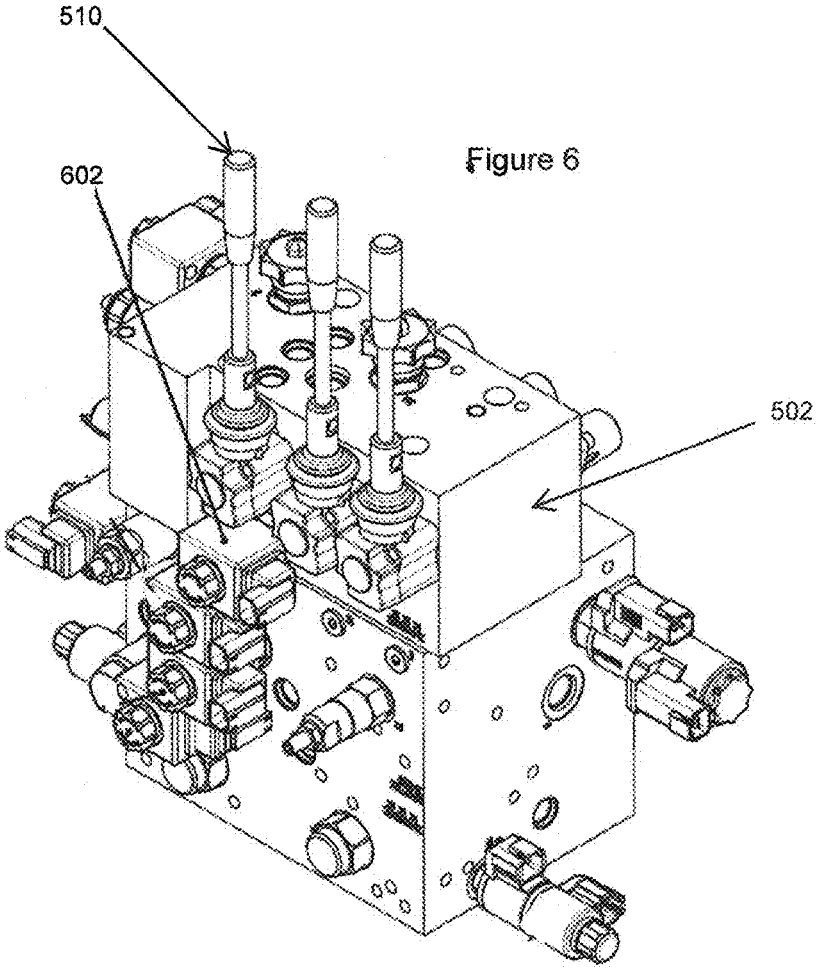
FIG. 6 is an alternative angle view of portions of main hydraulic manifold 502, first shown in FIG. 5.

Now referring to FIG. 6, where there is shown the main hydraulic manifold 502 from a different angle, which reveals the remote electronic mode solenoid 602 which is configured to provide the ability for the present invention to emulate the same changes in hydraulic pressure as would be caused by a manual manipulation of manual control lever 510. The systems as shown in FIGS. 5 and 6 are representative of the structure used to provide dual mode control for each control of operator control station 104 or the like.

Figure 7:
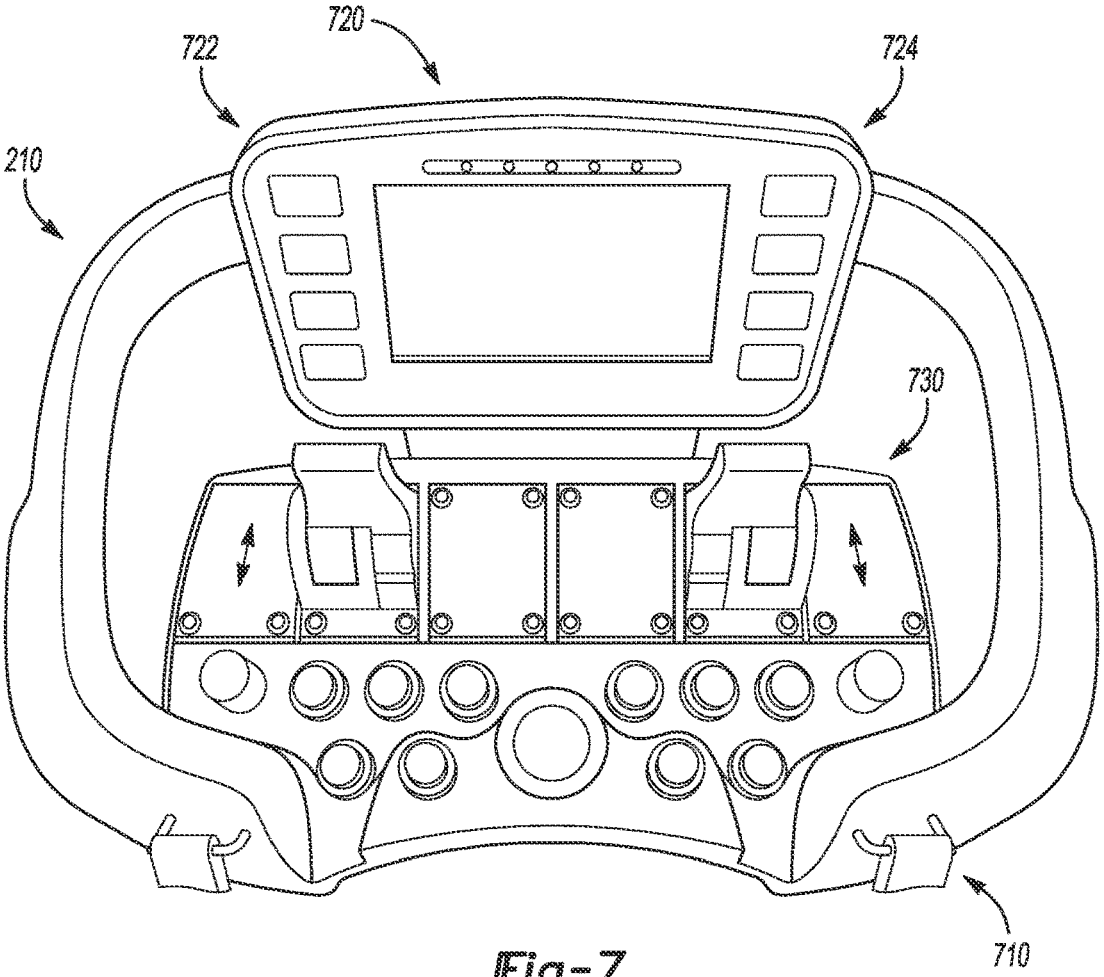
FIG. 7 is a close-up view of the mobile wireless remote operator control station 210 first shown in FIG. 2.
Figure 8:
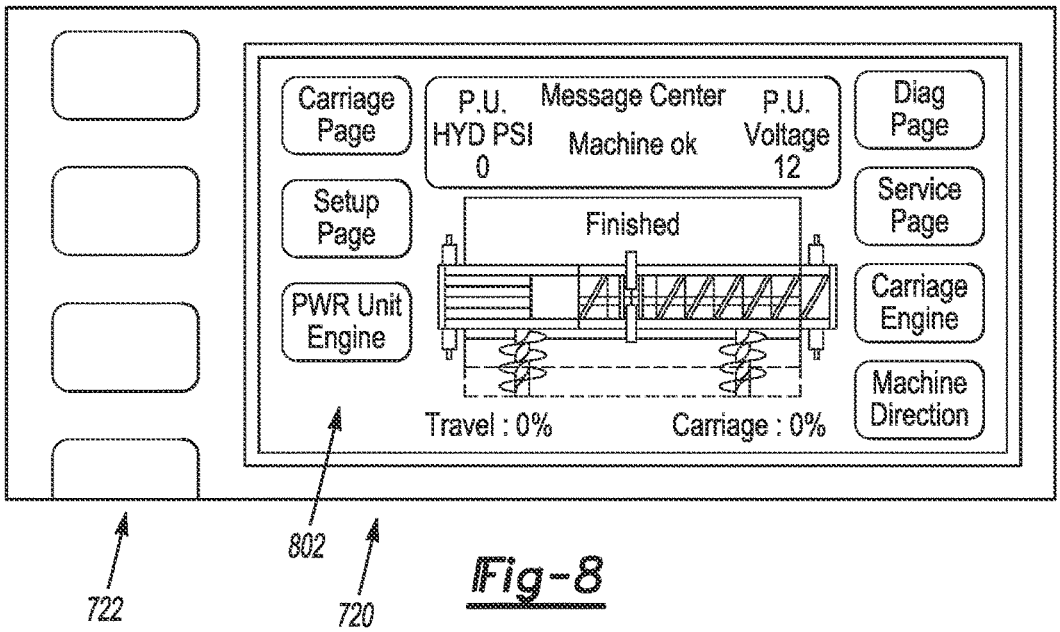
FIG. 8 is a close-up view of portions of the variable I/O and display module 720 first shown in FIG. 7, in an activated state.

Now referring to FIGS. 7 and 8, there is shown the mobile wireless remote operator control station 210 of FIG. 2 which includes a lanyard 710, a variable I/O and display module 720 (with its electronic flat panel display screen 802), a mobile wireless remote operator control station base portion 730. Variable I/O and display module 720 is shown with first array of variable select keys 722 and second array of variable select keys 724. In one embodiment, mobile wireless remote operator control station base portion 730 contains manual controls of a selection of the most used, most critical, most requiring a tactile interaction and others. Controls which are included on operator control station 204, but are not included on mobile wireless remote operator control station base portion 730, can be achieved using the electronic flat panel display screen 802 in combination with the first array of variable select keys 722 and second array of variable select keys 724. FIG. 8 shows a page which is representative of many interactive screens which could display different information. On the right side of electronic flat panel display screen 802 is an array of four vertical boxes which serve as electronically variable labels for the static second array of variable select keys 724 in registration therewith. On the left side, this particular screen has only three vertical boxes in registration with the top three variable select keys of first array of variable select keys 722. With the combination of the tactile controls chosen for mobile wireless remote operator control station base portion 730 and the limitless number of controls which could be controlled with the first array of variable select keys 722 and second array of variable select keys 724, along with the many screens which could be navigated to on electronic flat panel display screen 802, all of the features of operator control station 104 and operator control station 204, could be controlled remotely from mobile wireless remote operator control station 210.

One particularly helpful aspect of the method of the present invention is achieved during a scenario where the paver is in operation during a pour and the paver is automatically operating under pre-programmed and pre-set parameters, the operator from the operator control station 204 believes that there may be an issue with concrete surface at the far end of concrete paver frame boom 110 and on the opposite side of the carriage 211, the operator, wearing the mobile wireless remote operator control station 210 around the operator's neck, walks toward the distal end of the concrete paver frame boom 110 and there determines that a quick change in direction of travel along the concrete paver frame boom 110 is needed, a control is engaged on mobile wireless remote operator control station 210, and the direction of the carriage 211 immediately changes, without the remotely locatable concrete bridge paver operator 202 needing to return to the operator control station 204. In one embodiment, the remotely locatable concrete bridge paver operator 202 could actuate a control on mobile wireless remote operator control station 210 which provides for a variable carriage shift that has an incremental translation distance. This can be a one-time adjustment of the carriage direction shift and the automated carriage parameters would continue thereafter. The concrete bridge paver 200 continues to operate as previously programed without any further commands. If then the remotely locatable concrete bridge paver operator 202 determines that the carriage speed is too fast, it can be immediately changed using mobile wireless remote operator control station 210 without the need to return to the operator control station 204. The operation of the concrete bridge paver 200 will then continue with its automatic operation, except now with the new lower carriage speed. No other actions are required to resume automated operation. In such a scenario, the remotely locatable concrete bridge paver operator 202, armed with the mobile wireless remote operator control station 210, was able to avoid an imminent potential for reaching a point of non-compliance. Avoiding such non-compliance before it occurs is much preferred to addressing it after it exists.

The precise implementation of the present invention will vary depending upon the particular application.

It is thought that the method and apparatus of the present invention will be understood from the foregoing description and that it will be apparent that various changes may be made in the form, construct steps and arrangement of the parts and steps thereof without departing from the spirit and scope of the invention or sacrificing all of their material advantages. The form herein described is merely a preferred and/or exemplary embodiment thereof

We claim:

1. A method of improving operation of an automated concrete paver, comprising the steps of:

providing a control station which is disposed on a concrete paver, where the control station is configured with controls so that movement of an actuator by a paver operator results in a first change in pressure at a first manipulatable implement separated from said control station;

providing a mobile wireless operator control which is configured to cause said first change in pressure to occur when an input action occurs at said mobile wireless operator control;

said paver operator moving with said mobile wireless operator control to a second location where a determination is made to cause said first change in pressure to occur; and while a first configuration of paving is underway, said paver operator manually interacts, at said second location, with a first button on said mobile wireless operator control without any manual interaction with said control station, and thereby causes said first change in pressure to occur.

2. The method of claim 1 wherein said actuator is further configured with a first input and an electronic lead.

3. The method of claim 2 wherein pressing on and causing said first change in pressure to occur and where interaction with a first remote actuator will result in providing a first electrical signal on said electronic lead, which is also configured to cause said first change in pressure to occur.

4. The method of claim 1 wherein said control station further comprises a first hydraulic manifold and a second hydraulic manifold.

5. The method of claim 4 wherein said actuator is disposed on said second hydraulic manifold.

6. The method of claim 5 wherein said control station further comprises a manual control lever disposed on said first hydraulic manifold and an electronic mode solenoid is disposed adjacent to said manual control lever.

7. The method of claim 6 wherein said mobile wireless operator control further comprises a display screen which displays a video signal originating from a wireless camera and sensor pod at a third location;

said paver operator makes a determination from viewing said display screen that a closer view of said third location distant from said paver operator is desired; and said paver operator moves with said mobile wireless operator control to said third location where a determination is made to cause a second change in pressure at a second manipulatable implement separate from the control station to occur.

8. A system for improving operation of a concrete paver comprising:

a control station which is disposed on a concrete paver where the control station is configured with manual hydraulic controls so that movement of a manual actuator by a paver operator results in a first change in hydraulic pressure at a first hydraulically manipulatable implement separate from the control station;

a mobile wireless operator control, which is configured to cause said first change in hydraulic pressure to occur when an input action occurs by said paver operator with said mobile wireless operator control;

said concrete paver having a first location distant from said control station, and a second location; and said mobile wireless operator control being configured to wirelessly communicate from said second location to said control station after a determination has been made to cause said first change in hydraulic pressure to occur.

9. The system of claim 8 wherein said manual actuator comprises a first manual input and an electronic lead and wherein said mobile wireless operator control further comprises a first button.

10. The system of claim 9 wherein said control station is further configured such that pressing on said first manual input will result in causing said first change in hydraulic pressure to occur and where manual interaction with said first button will result in providing a first remote electrical signal on said electronic lead, which is also configured to cause said first change in hydraulic pressure to occur.

11. The system of claim 10 wherein said control station further comprises a first hydraulic manifold and a second hydraulic manifold.

12. The system of claim 11 wherein said manual actuator is disposed on said second hydraulic manifold.

13. A system for improving operation of a concrete paver comprising:

a control station disposed on a concrete paver where the control station is configured with manual hydraulic controls, including a manual actuator, when moved by a paver operator results in a first change in hydraulic pressure at a first hydraulically manipulatable device separate from the control station;

an electronic controller, which is configured to cause said first change in hydraulic pressure to occur when an input action occurs by said paver operator with said electronic controller;

said concrete paver having a first location distant from said control station, and a second location; and said electronic controller being configured to electronically communicate from said second location to one of said first location and said control station after a determination has been made to cause said first change in hydraulic pressure to occur.

14. The system of claim 13 wherein said manual actuator comprises a first manual input and an electronic lead and wherein said electronic controller is a movable electronic controller and further comprises a first button.

15. The system of claim 14 wherein said control station is further configured such that pressing on said first manual input will result in causing said first change in hydraulic pressure to occur and where manual interaction with said first button will result in providing a first remote electrical signal on said electronic lead, which is also configured to cause said first change in hydraulic pressure to occur.

16. The system of claim 15 wherein said control station further comprises a first hydraulic manifold and a second hydraulic manifold.

17. The system of claim 13 wherein said hydraulically manipulatable device is disposed at said first location.

18. The system of claim 13 wherein said electronic controller is a mobile wireless operator control.

19. The system of claim 18 wherein said mobile wireless operator control is a mobile wireless operator control station.

* * * * *